US008007410B2

(12) United States Patent
Mayaud

(10) Patent No.: US 8,007,410 B2
(45) Date of Patent: Aug. 30, 2011

(54) REMOVABLE DEVICE ALLOWING STATIONARY SWIMMING IN AN ABOVE-GROUND SWIMMING POOL OR SELF-SUPPORTING SWIMMING POOL

(76) Inventor: Christophe Mayaud, Sorgues (FR)

( * ) Notice: Subject to any disclaimer, the term of this patent is extended or adjusted under 35 U.S.C. 154(b) by 0 days.

(21) Appl. No.: 12/278,542

(22) PCT Filed: Feb. 7, 2007

(86) PCT No.: PCT/FR2007/000224

§ 371 (c)(1),
(2), (4) Date: Jun. 18, 2009

(87) PCT Pub. No.: WO2007/090963

PCT Pub. Date: Aug. 16, 2007

(65) Prior Publication Data

US 2010/0009813 A1 Jan. 14, 2010

(30) Foreign Application Priority Data

Feb. 7, 2006 (FR) ..... 06 01071

(51) Int. Cl.
*A63B 31/00* (2006.01)
*A63B 21/04* (2006.01)

(52) U.S. Cl. ..... 482/55; 482/129

(58) Field of Classification Search ..... 482/51, 482/55, 69, 121, 122–124, 125, 129–130; 434/254

See application file for complete search history.

(56) References Cited

U.S. PATENT DOCUMENTS

| | | | | |
|---|---|---|---|---|
| 4,247,096 | A * | 1/1981 | Schmitt | 482/55 |
| 4,530,497 | A * | 7/1985 | Moran et al. | 482/55 |
| 5,536,228 | A * | 7/1996 | Tanner, Jr. | 482/130 |
| 6,251,049 | B1 | 6/2001 | Milton | |
| 6,421,846 | B1 | 7/2002 | Shaanan et al. | |
| 6,612,845 | B1 * | 9/2003 | Macri et al. | 434/247 |
| 6,966,870 | B2 * | 11/2005 | Lan | 482/55 |
| 7,273,444 | B2 * | 9/2007 | Chang | 482/55 |
| 7,442,151 | B1 * | 10/2008 | Berdegue | 482/55 |
| 2005/0215398 | A1 * | 9/2005 | Lan | 482/55 |
| 2006/0122044 | A1 * | 6/2006 | Ho | 482/123 |
| 2006/0160681 | A1 * | 7/2006 | McBride et al. | 482/123 |
| 2006/0194680 | A1 * | 8/2006 | Croft | 482/123 |

FOREIGN PATENT DOCUMENTS

WO WO 02/09824 A 2/2002

* cited by examiner

*Primary Examiner* — Fenn Mathew
(74) *Attorney, Agent, or Firm* — Egbert Law Offices PLLC

(57) ABSTRACT

A device for stationary swimming in an above-ground or self-supporting swimming pool includes an item of equipment intended to surround the body of a swimmer, a flexible tether fastened at one end to the item of equipment, and at least one attachment pole with at least one hitching point for fastening to the other end of the tether. The base of the attachment pole is removable manner and has at least one anchoring plate extending laterally with respect to the base of the pole. The plate has an elongate shape and a size such that a large portion of its length can be slipped beneath one of the ends of a water basin lying on the ground. The mass of water contained in the basin firmly blocks the pole, thereby immobilizing and stabilizing the attachment pole.

10 Claims, 4 Drawing Sheets

REMOVABLE DEVICE ALLOWING STATIONARY SWIMMING IN AN ABOVE-GROUND SWIMMING POOL OR SELF-SUPPORTING SWIMMING POOL

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention concerns a removable device allowing stationary swimming in an above-ground swimming pool or self-supporting swimming pool.

More precisely, the invention is attached to a device allowing stationary swimming in a water basin suitable for holding a relatively small volume of water, in particular, a swimming pool of reduced dimensions, preferable removable or above-ground.

It is especially thought to apply the invention for stationary swimming in small above-ground swimming pools, such as removable swimming pools, consisting for example of a pliable, water-proof liner that is kept in shape by a rigid or flexible peripheral structure, the invention allowing confirmed swimmers with or without flippers or beginning or still learning swimmers to move around in the middle of said swimming pools.

The invention is also applicable to the equipment of water basins or swimming pools that are intended to be used for conditioning or adaptive aquatics, under medical supervision or not, of persons recovering from an illness or an accident and for whom swimming in large swimming pools would be premature and not advisable, or even dangerous.

2. Description of Related Art Including Information Disclosed Under 37 CFR 1.97 and 37 CFR 1.98

The majority of water basins allowing stationary swimming make use of tethers, being elastic or not, and tie the swimmer who is equipped with a harness or a lap belt to one or several fixed points on the rim of the swimming pool or on the bottom of the swimming pool. The invention relates to a system applying a method of this kind.

In the documents, U.S. Pat. Nos. 4,247,096, 4,577,859, 4,527,795, 6,251,049 GB-2 214 800, GB-2 382 525, WO-2002/09824, WO-2004/012827, the swimmer is either tied by a tether, elastic or not (U.S. Pat. No. 4,527,795), to a fixed point, generally by a ring incorporated into the side wall of the swimming pool or to a rigid structure that is solidly tied into one of the end sides of the swimming pool, or to the upper portion of a pole that is firmly placed into the ground outside of the water basin, thus allowing to block or to reduce the effects of progression of the swimmer in the water basin.

The devices described in the aforementioned documents apply necessarily to swimming pools built of solid and rigid materials allowing the fastening of the attachment points to the walls of said swimming pools or to a pole placed in the ground, outside of and in proximity to said pools.

The known aforementioned devices do not allow their implementation on removable pliable swimming pools, such as those formed by a pool of water supported by an inflatable ring or more generally those formed by a liner placed on the ground, the bottom surface of the liner resting directly on the ground which may not be perfectly flat.

Furthermore, swimming pools equipped with one or several hitching points on their rims present a potential source of injuries, for example, while children are playing in the water. Besides, the rims are rather unaesthetic due to the presence of auxiliary devices attached to the edge of the swimming pools.

BRIEF SUMMARY OF THE INVENTION

The invention intends to provide a simple and economical solution to the aforementioned problems which are not resolved by the methods and devices of the state-of-the-art.

According to the invention, this objective has been achieved by a device comprised of:

- equipment intended to be wrapped around the body of a swimmer; and
- a supple, preferably elastic, retaining tether, fastened or fitted to be fastened, by means of one of its ends, to said equipment, said device being essentially remarkable because it includes also:
  - at least one attaching pole allowing the fastening of the other end of the retaining tether and at least one anchoring plate fastened or fitted to be fastened in a removable manner to the base of the pole. This plate has an elongate shape and a size such that a large portion of its length can be slipped beneath one of the ends of a water basin of the above-ground or the self-supporting kind, with the result that it is firmly blocked by the weight of the water contained in said basin, thereby immobilizing and stabilizing the attachment pole fastened to said plate.

This device maybe used on all swimming pools, pliable ones like those consisting of a liner, or rigid ones like the swimming pools described in the state-of-the-art or any other swimming pools, by the installation of a removable fixed point kept in place by said swimming pool.

This removable device may be used in a localized manner on the swimming pools, allowing the original aesthetic aspect of said swimming pools to be maintained without modification of their structures. Additionally, since there is no roughness on the rim or edge of the swimming pool, it is possible to forestall any risk of injury, as could occur for example when small children are playing in the water.

BRIEF DESCRIPTION OF THE SEVERAL VIEWS OF THE DRAWINGS

The aforementioned aims, characteristics and advantages, and others still, will appear better in the following description and the attached drawings.

DETAILED DESCRIPTION OF THE INVENTION

Reference to said drawings is made to describe an interesting, albeit by no means limiting, example of execution and implementation of the device according to the invention.

In the description and the claims of the present application, the term "above-ground" and the word "self-supporting" designate swimming pools that are installed on the ground S without costly preparation (no earth work), the ground being only graded and cleared of protruding roots and undesirable stones.

Figure 1:
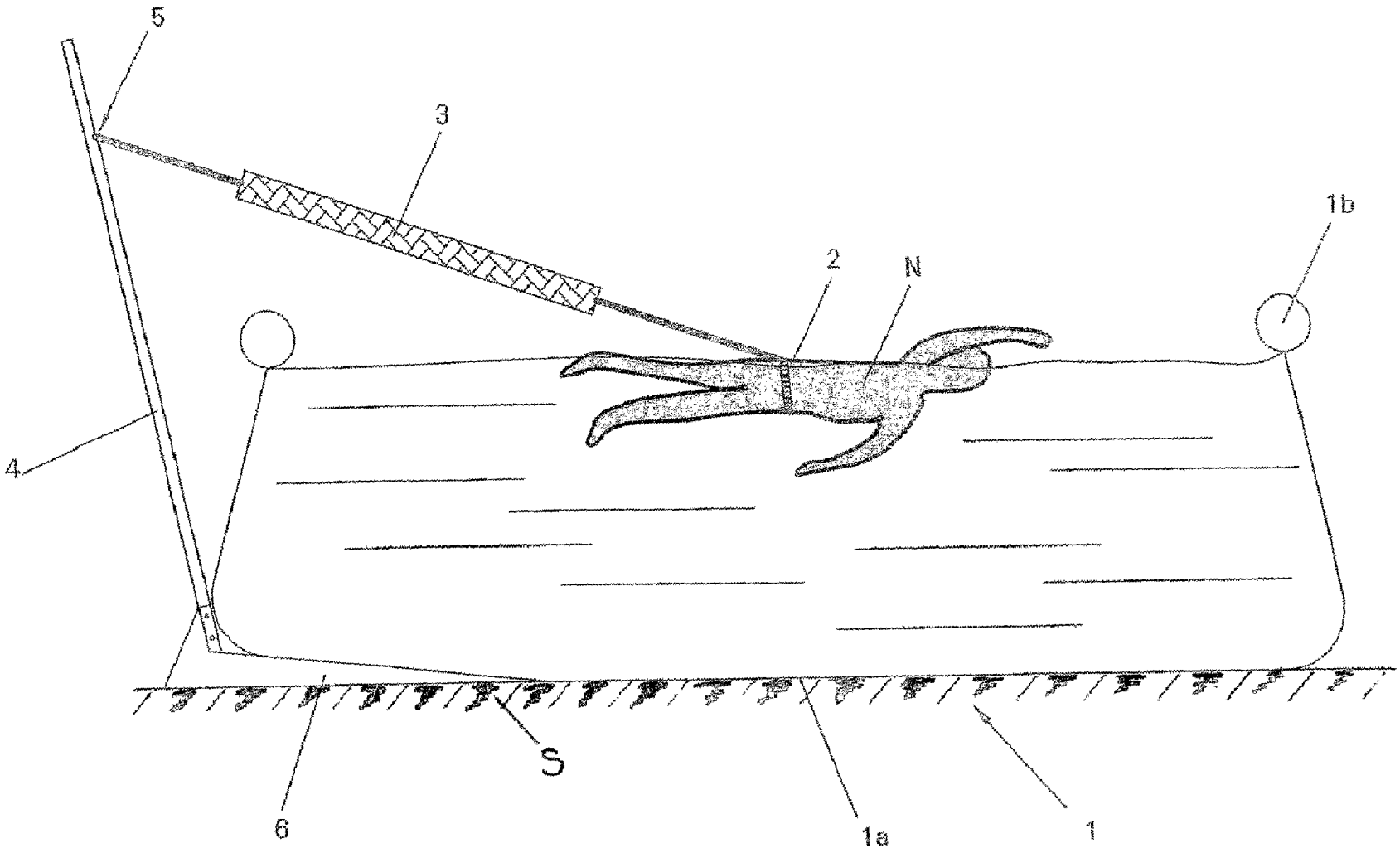
FIG. 1 is a schematic view and partial longitudinal sectional view of an example of execution of the swimming device implemented in a swimming pool of the self-supported type with an inflatable ring, being kept on the ground by the swimming pool.
Figure 2:
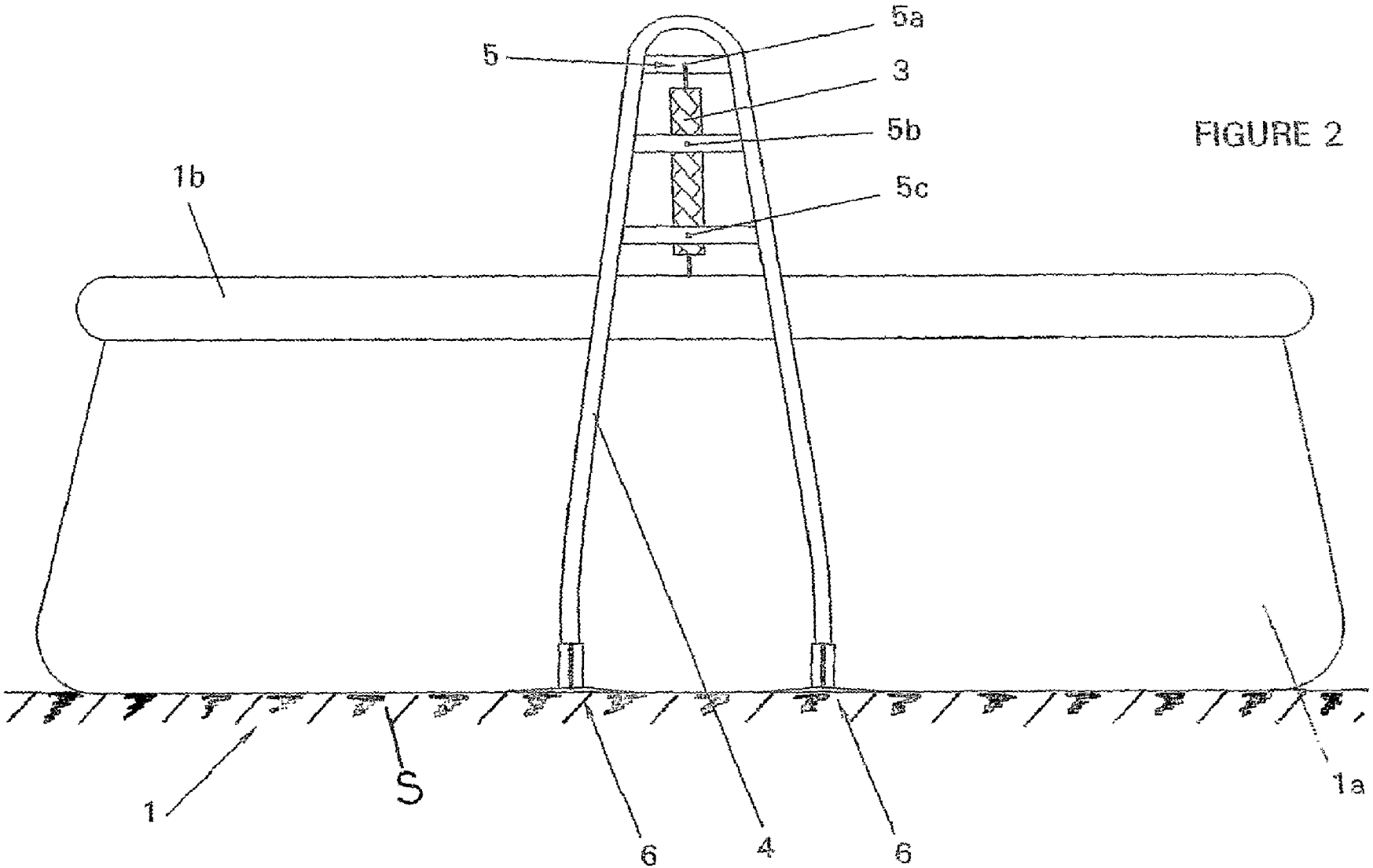
FIG. 2 is a front elevation view of the end of the swimming pool equipped with the swimming device of the present invention.
Figure 3:
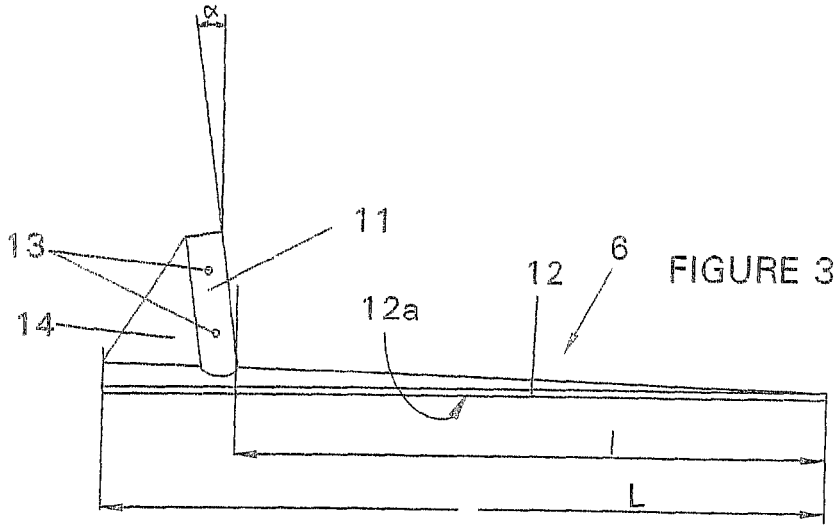
FIG. 3 is a side elevation view of the anchoring plate of the swimming device.
Figure 4:
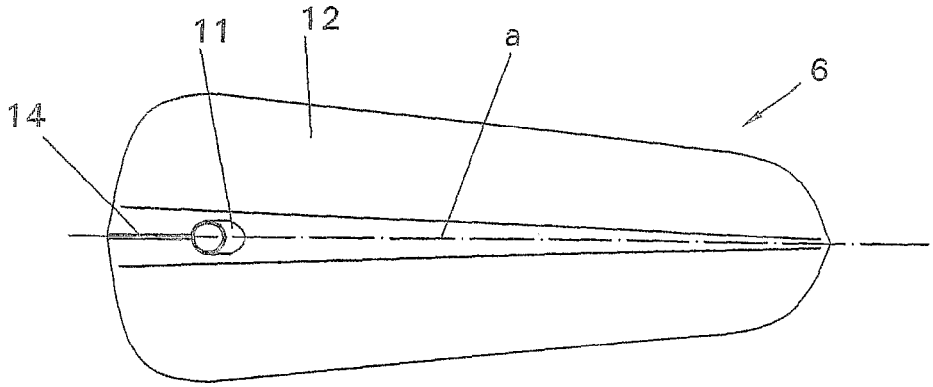
FIG. 4 is a top plan view of FIG. 3.
Figure 5:
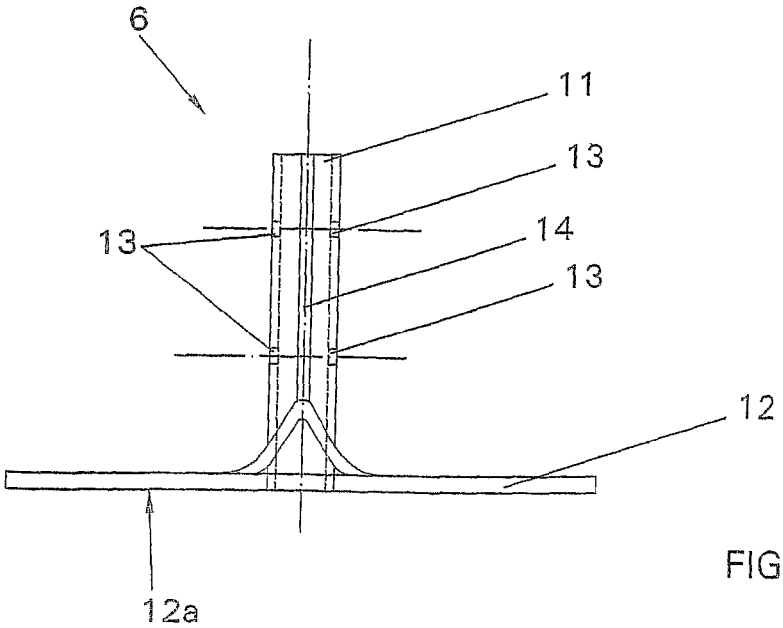
FIG. 5 is a rear elevation view of the anchoring plate.

FIG. 1 shows a removable swimming pool above-ground 1 which is equipped with a removable device allowing stationary swimming. According to the interesting application shown, this swimming pool is of the known type comprised of a pliable watertight liner 1*a*, which is maintained in its shape by an inflatable peripheral circular tube lb, resting directly on the ground S in an operating position.

The device allowing stationary swimming includes equipment 2 intended to be placed around the body of a swimmer N and which may consist of a belt, a harness, a cross belt or similar, preferably having a snap-on fastener and a supple retaining tether 3, attached or attachable, by one of its ends provided with a snap-on fastener system, to said equipment.

The swimmer (N) is attached to one of the ends of the pliable tether 3, byway of a large pelvic belt 2 or a harness, with a quick snap-on/off fastener, adjustable with a fastening or attachment point, on the back between the swimmer's (N) kidneys. Said belt 2, or harness, is made of an inert material in relation to products currently used in swimming pools.

The pliable tether 3 is advantageously constituted by a tether featuring an elastic stretch capacity such as an elastic cord an elastic strap or a similar device.

According to a characteristic disposition, the device, as per the invention, also includes at least one rigid pole 4 equipped in its upper portion with at least one attachment point 5 allowing the fastening of the other end of the retaining tether 3, and at least one anchoring plate 6, or fitting, to be able to be fastened in a removable manner, to the base of said attaching pole.

Figure 6:
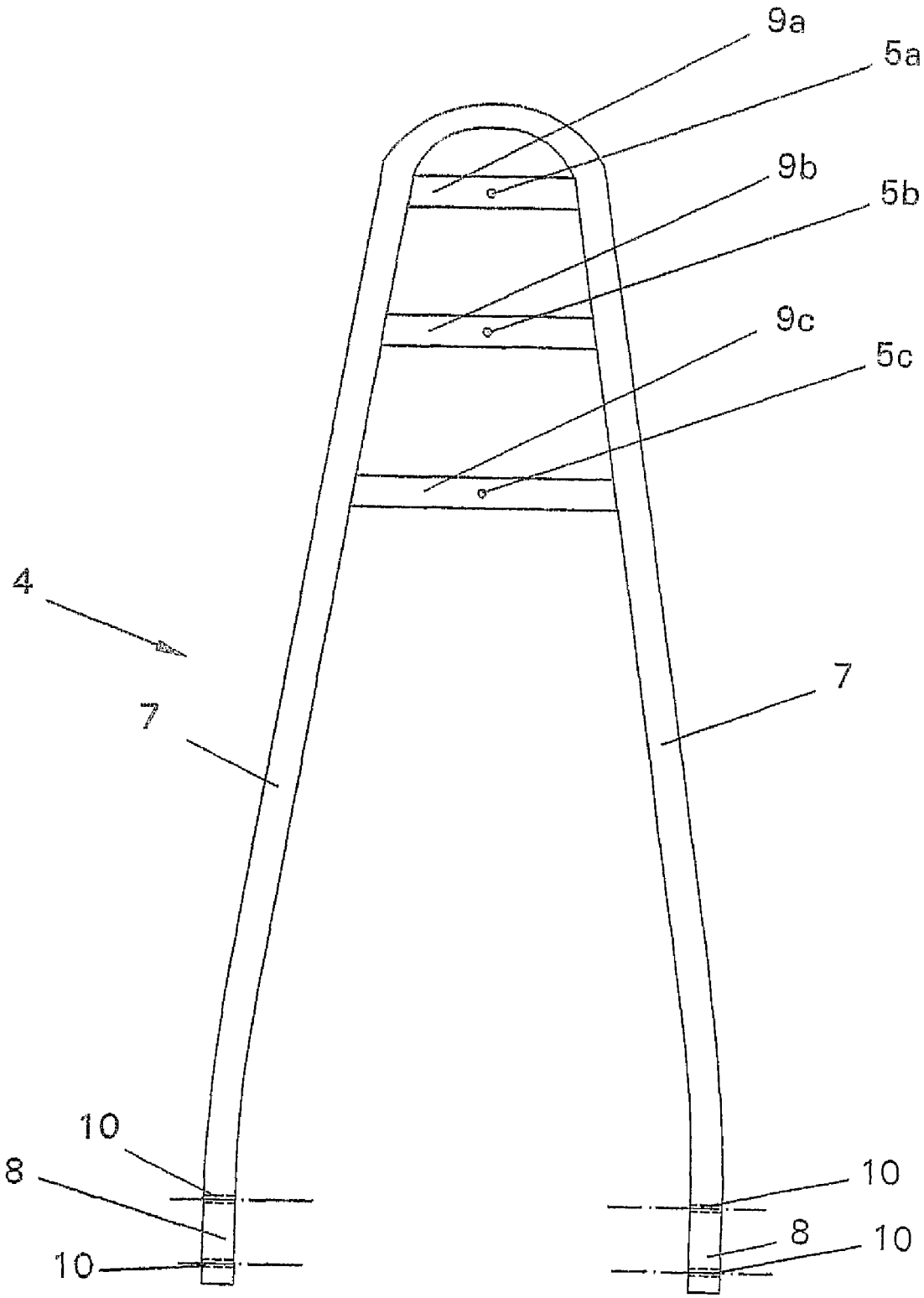
FIG. 6 is a front elevation view of the attachment pole of the tether of the swimming device.

The attachment pole 4 may be formed by a rigid tube, made for instance of aluminum, of carbon fiber or of aramide resin such as KEVLAR (™), preferably of a cylindrical shape. According to the illustrated example (FIG. 6), the tube is arched in its upper portion to form two legs 7 spreading away from each other and terminating in their lower portion in two straight stumps 8. In their upper portion, the legs 7 are connected by staggered cross members 9*a*,9*b*,9*c* preferably formed by plane rectangular bars that are spaced and fastened to said legs 7, for instance by welding, heat sealing or gluing and with one drilled hole 5*a*,5*b*,5*c* in their middle.

The spaced cross-braces 9*a*,9*b*,9*c*, which are associated to the holes 5*a*,5*b*,5*c* respectively, serve as fixed attachment points of the retaining tether 3.

According to the illustrated example, the actual attachment pole 4 is meant to be rigidly attached, in a removable manner, on two anchoring plates 6.

In this case, the lower portions 8 of the legs 7 are provided with holes 10 with axes that are perpendicular to said portions and intended to allow the passage of the stem of a fastener (not shown).

Of course, the attachment pole could be constituted of a single column fixed at its base, or fitted so it can be fixed, to a single anchoring plate (6).

The anchoring plate 6 or each anchoring plate 6 may be permanently attached to the lower end of the leg or the legs 7 of the attachment pole proper 4, or it may be attached in a removable manner to said end by any suitable fastening system and organs.

According to the illustrated example of execution, the device according to the invention comprises two anchoring plates 6 that are each attached to the lower end 8 of a leg 7 of the attachment pole 4.

The anchoring plate 6 or each anchoring plate 6 extends laterally relative to the base of the attachment pole 4. It is essentially constituted by a plate 12 presenting an elongated shape and a length L so that the major part I of this length can be slipped beneath one of the ends of an above-ground or self-supporting water basin so as to find itself firmly blocked in a stationary position by the weight of the water in the basin.

The anchoring plate 6 or each anchoring plate 6 comprises a plane bottom surface 12*a*, and it is equipped on its upper face with means allowing its removable fastening to the lower end 8 of at least one leg 7 of the attachment pole 4.

According to the illustrated example, each anchoring plate 6 is equipped, on its upper face, with a tube 11 located near its rear end and demarcating the part I of its length intended to be slipped beneath one of the ends of the swimming pool resting on the ground.

In assembly position, the straight lower parts 8 of the legs 7 fit into the tubes 11 of the plates 6 of the stationary swimming device, said tubes presenting a section, circular for instance, and fitting properly with the shape of the straight lower portions 8 of the legs 7. The tubes are slightly above the section of said portions 8 of said legs 7, thus the tubes are able to be inserted into the portions 8 of legs 7 and pulled out of the portions 8 of legs 7 without having to force the tubes. The tube 11 comprises transversal drilled holes 13 in accordance with a distance between centers that is identical to the spacing obtained by the holes 10 of the legs 7 so that the stem of a fastener, for instance of a screw and a nut, can pass through the holes 10 and the holes 13, thereby making the pole 4 integral to the anchoring plates 6, when the pole 4 is inserted and locked in said tubes 11.

The tube 11 is bent backwards at a certain angle allowing, after positioning of the pole 4, to obtain an inclination of the latter towards the outside of the swimming pool. The attachment pole is implanted in this manner now forming an obtuse angle, for instance in the order of 100° with the plate 12.

The tube 11 may be reinforced by at least one rib 14, located essentially in back of the tube, allowing to contain the stresses of the pole 4 and to stiffen said tube 11.

The position of the holes 13 allows installing and fastening the pole 4 and the plates 6 in such a way that the main axis (a) of said plates finds itself located at a right angle relative to the straight line connecting the base of the two legs 7 of the pole 4.

The anchoring plate 6 or each anchoring plate 6 may be made of a material similar to that of the pole 4, and it may include on its upper face, a rib located in its main axis (a), this rib being executed directly by pressing or being separate, for example by welding of a plate bent in the shape of an upside down V.

The tubes 11, serving as housings to the lower portions 8 of the legs 7 of the pole 4, are rigidly fastened on the plane plate 12, for instance by welding, heat sealing or gluing, and being stiffened by at least the rib 14. The ends of the plane plate 12 forming the plate 6 feature rounded non-aggressive shapes and said plate has a shape that is tapered towards the front.

The holes 5*a*,5*b*,5*c* drilled in the staggered stiffening bars 9*a*,9*b*,9*c* of the pole 4 represent different fixed points 5, enabling the attachment of the elastic retaining tether 3 at different heights, this allowing regulation of said retaining tether relative to the horizontal formed by the surface of the water contained in the swimming pool.

Regulation of the inclination of the elastic retaining tether 3, by modifying the fixed attachment point 5, makes it possible to adapt the swimming device to the level of proficiency of the swimmer (N) moving in the swimming pool. For excellent swimmers, the attachment of the elastic tether 3 to the pole 4 should be at the lowest anchoring point 5*c*. Inversely, for beginning swimmers, the fastening of the elastic tether 3 to the pole 4 must be at the highest anchoring point 5*a* which provides support for the swimmer (N). At least one intermediary fastening point 5*b* allows regulating the inclination of the elastic tether depending on the different levels of the swimmers in the swimming pool.

It is obvious that the device according to the invention can be easily and quickly installed by a single person, on an above-ground swimming pool of the current self-supporting type. It suffices, as a matter of fact, after having, if applicable, pushed and blocked the lower end of the pole 4 or of the legs 7 of the pole into the anchoring plate(s) 6, to slide this (these) elongated plate(s) 6 which extend laterally relative to the axis of the pole 4 or the legs 7 of the latter, beneath the end of the swimming pool before filling it completely with water, and to then attach the retaining tether 3 to the attachment pole and to the body hardware 2 respectively. Removal of the device is just as easy and quick.

I claim:

1. An apparatus for placement on the ground so as to allow stationary swimming by a swimmer, the apparatus comprising:

an inflatable swimming pool having a bottom;

a securing means for wrapping around the swimmer;

a supple retaining tether attached at one end to the securing means;

an attachment pole having an attachment point at an upper end thereof, said supple retaining tether having an opposite end fastened to said attachment point; and an anchoring plate fitted to a base of said attachment pole, said anchoring plate extending laterally relative to said base of said attachment pole, said anchoring plate having an elongate shape such that a substantial portion of said length of said elongate shape of said anchoring plate has a side residing against said bottom of said inflatable swimming pool, said elongate plate having another side suitable for resting against the ground.

2. The apparatus of claim 1, said supple retaining tether being elastic.

3. The apparatus of claim 1, said attachment pole having a plurality of attachment points in stepped relation to each other, said plurality of attachment points suitable for selective attachment thereto of said supple retaining tether.

4. The apparatus of claim 1, said attachment pole extending at an obtuse angle with respect to said anchoring plate.

5. The apparatus of claim 1, said attachment pole having a pair of legs.

6. The apparatus of claim 5, said pair of legs having a plurality of cross members extending in staggered relation therebetween at an upper end of said pair of legs.

7. The apparatus of claim 5, said anchoring plate comprising a pair of anchoring plates respectively fastened to a lower end of said pair of legs.

8. The apparatus of claim 1, said anchoring plate having a tube extending upwardly therefrom at an rear end thereof, said base of said attachment pole fitted to said tube.

9. The apparatus of claim 8, said tube having holes formed therein, said base of said attachment pole having holes formed therein so as to align with said holes of said tube, the apparatus further comprising:

a fastener having a stem extending through at least one of said holes of said tube and through at least one of said holes of said base of said attachment pole.

10. The apparatus of claim 1, said anchor plate being removably fitted to a base of said attachment pole.

* * * * *